US005167197A

United States Patent [19]

Lavelle et al.

[11] Patent Number: 5,167,197

[45] Date of Patent: Dec. 1, 1992

[54] GARMENT COMPONENT FABRICATING SYSTEM AND METHOD

[76] Inventors: Edward R. Lavelle, Rte. 2, Box 12A, Staley, N.C. 27355; Charles M. Funderburk, Rte. 4, Box 160, East Bend, N.C. 27018; John C. McEwen, Rte. 8, Box 299, Mocksville, N.C. 27028; David C. Howell, 729 LaVale Dr., Clemmons, N.C. 27012

[21] Appl. No.: 702,339

[22] Filed: May 20, 1991

[51] Int. Cl.[5] ..... D05B 35/04

[52] U.S. Cl. ..... 112/262.3; 112/121.29; 112/130; 112/141; 112/147

[58] Field of Search ..... 112/141, 147, 121.27, 112/121.11, 130, 142, 143, 121.29, 121.15, 2, 262.1, 262.3

[56] References Cited

U.S. PATENT DOCUMENTS

| | | | |
|---|---|---|---|
| 3,277,851 | 10/1966 | Dobner et al. | 112/2 |
| 3,884,166 | 5/1975 | Rinehimer et al. | 112/141 |
| 3,898,941 | 8/1975 | Crawford et al. | 112/121.29 |
| 4,008,637 | 2/1977 | Crawford et al. | 83/155 |
| 4,040,366 | 8/1977 | Silverman et al. | 112/121.29 |
| 4,095,537 | 6/1978 | Silverman et al. | 112/141 X |
| 4,271,774 | 6/1981 | Burton | 112/141 X |
| 4,432,295 | 2/1984 | Raisin et al. | 112/141 |
| 4,594,955 | 6/1986 | Lichtenberg | 112/147 |
| 4,967,675 | 11/1990 | Goldbeck et al. | 112/141 X |

FOREIGN PATENT DOCUMENTS

| | | | |
|---|---|---|---|
| 2353404 | 5/1975 | Fed. Rep. of Germany | 112/141 |

*Primary Examiner*—Peter Nerbun

[57] ABSTRACT

A system is disclosed for continuously, sequentially, fabricating garment components from fabric blanks by orienting the blanks and sequentially advancing them to a first station where they are aligned with a continuous extending fusible interfacing tape. A heated plate folds a marginal edge of the blank at the first station into engagement with the interfacing tape and selectively applies heat and pressure to adhesively bond the fabric folded portion to the interfacing tape. The fabric blank and tape are advanced to a sewing machine where the blank is hemmed to define the garment component. A cutter removes the tape intermediate adjacent components and the components are subsequently collected.

11 Claims, 4 Drawing Sheets

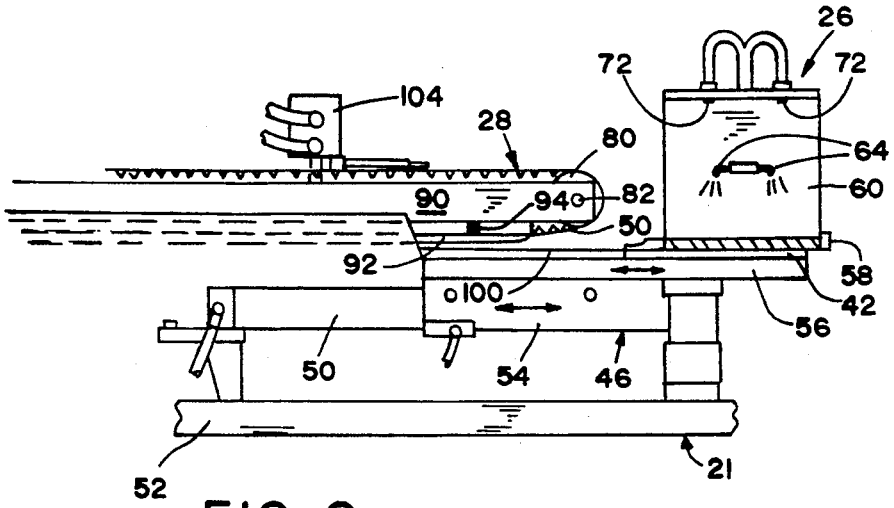
FIG. 2
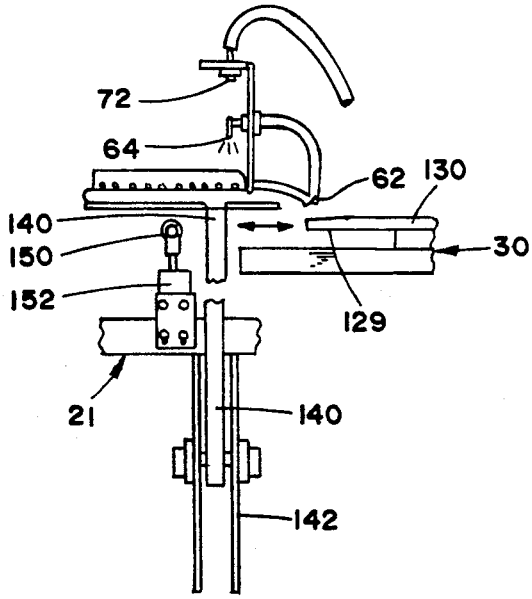
FIG. 4
FIG. 3
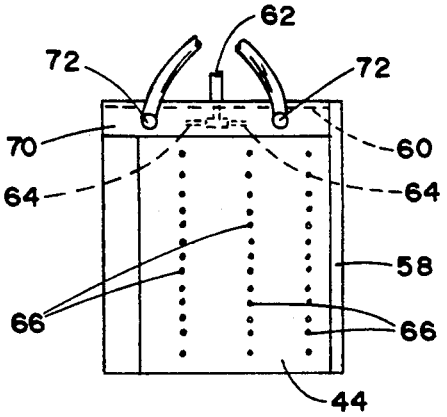
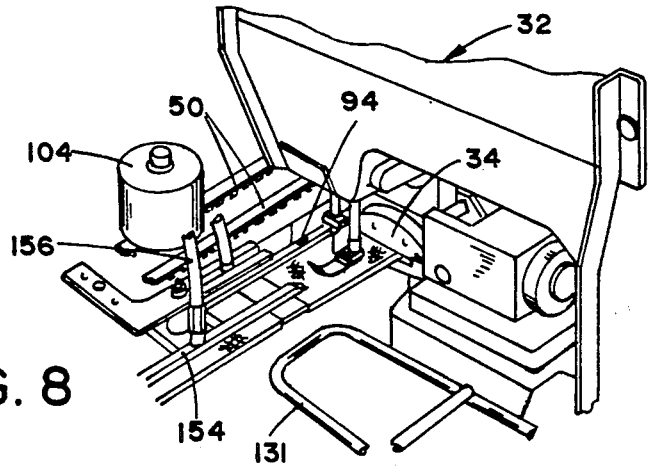
FIG. 8

GARMENT COMPONENT FABRICATING SYSTEM AND METHOD

This invention relates generally to a system for forming garment components including an interfacing liner or tape from fabric blanks, and more particularly to the folding, bonding and hemming of successive pieces of fabric as they are fed past sewing and separating means prior to stacking of the components.

Although the invention will be described in conjunction with the forming of hemfolds for garment pockets, the folding, feeding, sewing, separating and stacking concepts of the invention are susceptible to other uses where various other fabric or fabric-like pieces are folded and secured in a selected manner.

It is a primary object of the invention to provide a system for continuously forming in an efficient manner garment components.

Another object of the invention is the provision of a system for rapidly and accurately advancing, folding, and hemming fabric blanks without control by an operator.

A further object of the invention is a reliable apparatus reducing costs in forming lined, hemmed garment components.

Other objects and advantages of the invention will become apparent to those skilled in the art during the course of the following detailed description.

BRIEF DESCRIPTION OF THE FIGURES

FIG. 2 is an enlarged, fragmentary, side elevational view of the mechanism for advancing the fabric blanks;

FIG. 3 is a top plan view of the alignment plate of the blank alignment and advancing assembly;

FIG. 4 is a fragmentary, side elevational view of the assembly for folding the blanks and applying heat and pressure thereto;

FIG. 8 is a fragmentary, perspective view of the sewing mechanism for hemming the fabric blanks and the cutter assembly for severing the liner tape extending between adjacent blanks;

DETAILED DESCRIPTION OF THE INVENTION

Figure 1:
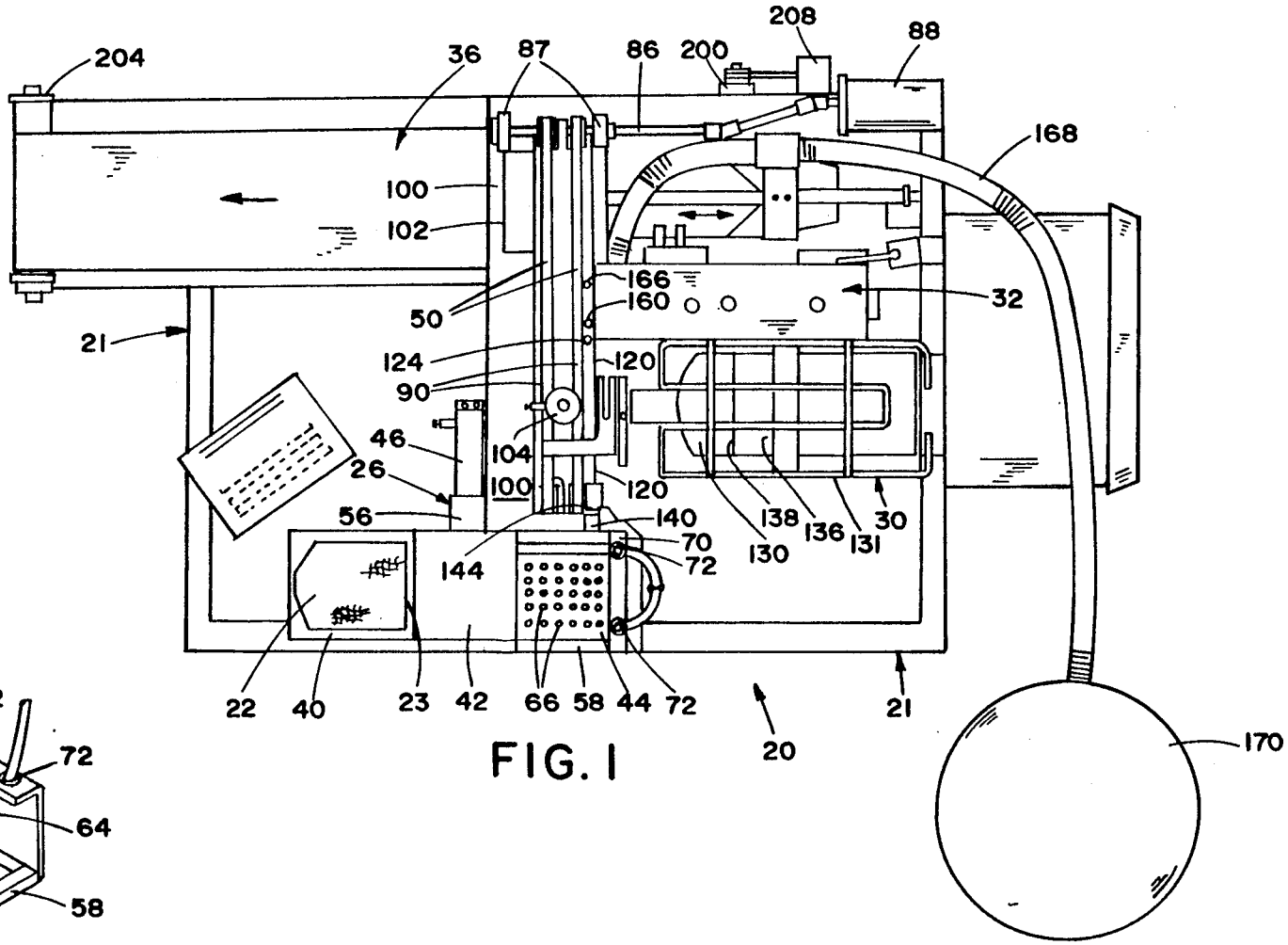
FIG. 1 is a schematic, top plan view of the apparatus.

Referring to the drawings, and particularly to FIG. 1, the apparatus 20 for the forming of fabric blanks 22 into garment pockets 24 includes a blank alignment and advancing assembly 26, a feeding assembly 28, a folding assembly 30, a stitching apparatus 32, a cutting mechanism 34 and a mechanism 36 for collecting and conveying the completed pockets, all such mechanisms and assemblies being supported upon a framework 21.

The blank alignment and advancing assembly 26 includes a first planar support 40 having a series of blanks 22 stacked thereon, a second planar support surface 42, and a perforated plate 44. The upper surfaces of the support 42 and plate 44 are flush with each other in order for an operator to remove a blank 22 from the stack of blanks, place the blank on surface 42 in a flattened condition and slide the blank onto the perforated plate 44 for orientation in a prescribed manner as will be subsequently described. The support surface 42 and the perforated plate 44 are secured together for reciprocable displacement by a band cylinder 46, FIGS. 1 and 2, to advance a properly positioned blank 22 to the belts 50 of the feeding assembly 28.

The fluid cylinder 46 incorporates switches for controlling the extent of movement, and includes a first portion 50, FIG. 2, secured to the support 52 of the framework 21 and a second portion 54 coupled to the support surface 42, through a member 56, for reciprocable displacement of the surface 42 and the perforated plate 44.

The perforated plate 44 has attached thereto along one edge portion a stop bar 58 and along another edge portion a vertically disposed plate 60. Supported by the vertically disposed plate is a fluid conduit 62 and horizontally spaced air jets 64. The conduit 62 is coupled to the jets 64 and also to the hollow interior of plate 44 so as to direct fluid through the openings 66 in the upper surface of the plate 44. The conduit 62 is connected to a suitable air source 59 for applying a slight air pressure upwardly through the openings 66 or for drawing a vacuum through the openings, as desired.

Figure 10:
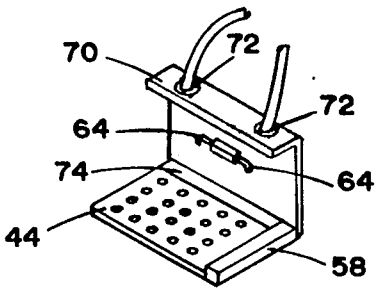
FIG. 10 is a fragmentary, perspective view of the assembly for assisting in orienting each blank prior to being advanced.

At the upper edge of the plate 60 is a support 70 having spaced electric eyes 72 mounted thereto. A reflective tape strip 74 is secured to the edge portion of the perforated plate 44 and abutting the vertical plate 60, as shown by FIG. 10.

When an operator lifts a blank 22 from the stack of blanks and places it on plate 42 in a flattened condition, the blank is then slid onto the perforated plate 44. A slight air pressure is directed through conduit 62, the openings 66 and the air jets 64 at this time. The air pressure through the plate openings 66 causes the blank to tend to float thus assisting in moving it into proper position on the plate 44 with one edge abutting stop bar 58 and with the straight edge 23, that will subsequently be folded and hemmed, positioned to be detected by the electric eyes 72. The air pressure through jets 64 removes any curls in the edge of the blank to be hemmed as it is moved towards plate 60 for sensing by the electric eyes 72. Once the eyes 72 determine that the blank is properly aligned, a signal is directed to the air source 59 for drawing a slight vacuum through the openings 66 of the plate 44 to hold the blank in the proper aligned position as the plate 44 and blank are advanced towards the feeding assembly 28 by the cylinder 46.

The feeding assembly 28 includes the drive belts 50, 50 which extend around pulleys 80, 80 supported upon a shaft 82 and pulleys 84, 84 supported upon a drive shaft 86. The shaft 86 is driven by a motor 88. The assembly also includes a pair of elongated supports 90, 90. A pair of elongated runners 92, FIGS. 2 and 11, are supported by the supports 90, 90 and are biased downwardly by a plurality of springs 94, against a horizontally disposed plate 100 supported by framework 21.

The plate 100 extends throughout the length of the drive belts 50, 50 and has an opening 102 therein, as will be subsequently described.

The forward end portion of the assembly 28 adjacent the alignment and advancing assembly 26 is free to pivot about the drive shaft 86 supported in bearing blocks 87, 87, FIG. 1 attached to frame 21.

Figure 11:
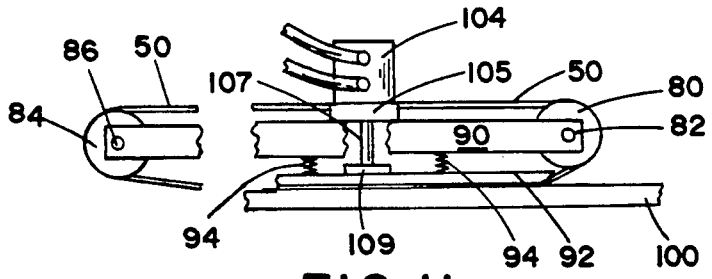
FIG. 11 is a fragmentary, side elevational view of the conveyor assembly for advancing the blanks to the folding, sewing, and severing assemblies.

Referring to FIG. 11, an air cylinder 104 is fixed to a plate 105 which extends transverse to and is fixed to the spaced parallel supports 90, 90. The cylinder rod 107 is fixed to a plate 109 extending between and secured to the spaced runners 92, 92. The springs 94 urge the runners 92, 92 and the supports 90, 90 away from each other.

When the blank 22 is moved forward by the plate 44, the supports 90, 90 are raised by the cylinder 104 to facilitate positioning the edge of the blank beneath the belts 50. The cylinder 104 then is actuated to lower the belts onto the blank forward edge to grasp the pocket just prior to the feeding of the blank by the belts.

The cylinder 46 moves the perforated plate 44, having a blank 22 held thereto by vacuum, forward until the blank is pinched between the driven belts 50 and the plate 100 as previously described and advanced rearwardly along the plate towards the pulleys 84. The plate 44 and blank 22 held thereon is positioned such that when advanced along the plate 100 by the belts 50, a predetermined section x depends from a straight edge 120 of the plate 100. While the width or length of the section x may vary, in a preferred embodiment, the blank depends approximately one inch below the top edge of the plate 100.

An electric eye 124 in the plate 100, FIG. 1, detects the edge of the blank 22 being advanced by the belts 50 and sends a signal to the controller which, in turn, deactivates the motor 88 to stop the drive to the belts 50 and blank.

With the blank in this fixed position, the folding assembly 30 is actuated. The folding assembly includes a heated plate 130 supported upon a band cylinder 132 for generally horizontal reciprocation thereby. In the forward position the tapered edge 134 of the heated plate is positioned underneath the plate 100 folding the section x of the blank 22 underneath the plate. An upper plate 136 is fixed to the heated plate and includes an abutting edge 138 for substantially engaging the edge 120 of plate 100 with only the thickness of the fabric blank therebetween. A guard 131 is provided above the heated plate 130.

Figure 7:
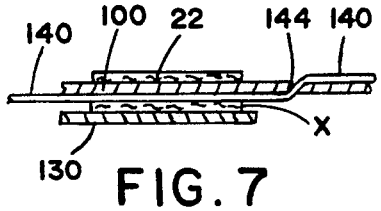
FIG. 7 is a view taken along line 7—7 of FIG. 6.

A fusible interfacing liner tape 140 is provided for holding the folded section x of the blank until the stitching forms a hem H of the marginal section x. The liner tape 140 which does not stick in the cold state and a heat actuatable adhesive on only one side is directed from a spool 142, FIG. 4, or other suitable dispenser, over the plate 100 but beneath the perforated plate 44 and then through a slot 144 in the plate to a location below and parallel to the plate 100, as shown by FIGS. 1 and 7. The liner tape 140 is advanced from the spool 142 as blanks 22 are sequentially advanced by the perforated plate 44 and the drive belts 50. Thus the liner tape serves to connect the blanks until after the hem H has been formed by the sewing machine 32 and insure that the fabric will be kept in the proper folded condition when fed to the sewing machine.

As the hot plate 130 is advanced forward, FIG. 4, the lower surface 129 moves to a position over the roller 150 and is crammed upwardly by the roller as it is advanced to clamp the fabric section x and the liner tape 140 between the plate 130 and the lower portion of plate 100. Pressure on the roller 150 is maintained by an air regulator 152. The temperature of the hot plate 130 is sufficient to activate the adhesive and weld only the section x of the fabric to the width of the fusible tape 140.

Figure 5:
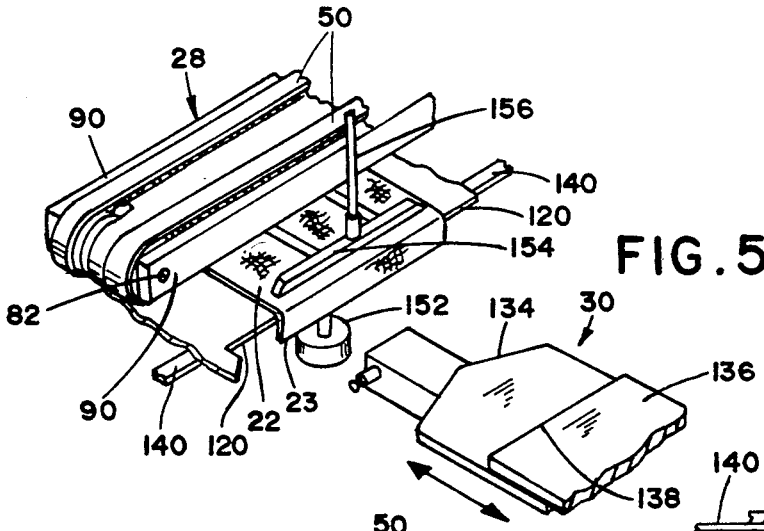
FIG. 5 is a fragmentary perspective view of a portion of the apparatus of FIG. 4 and illustrating the fabric blank prior to being folded by the heated plate.
Figure 6:
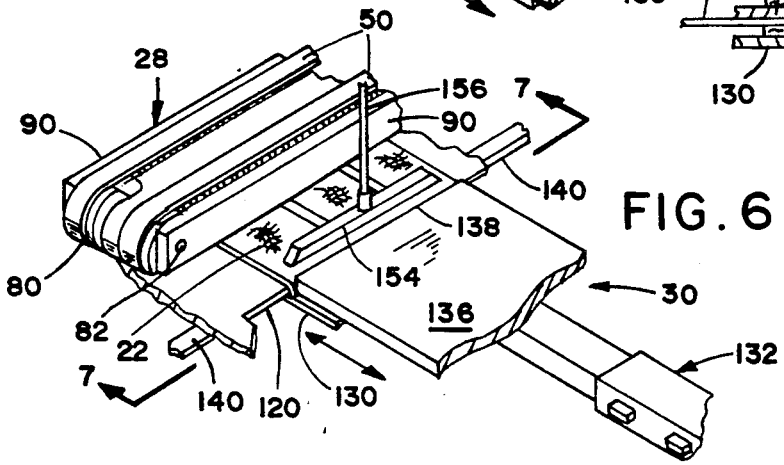
FIG. 6 is a view similar to FIG. 5 with the heated plate moved to a position for folding the blank and applying heat thereto.

A folderjet 154, FIGS. 5, 6, is provided just above the edge 120 of the plate 100 to assist in urging the section x of the fabric under the plate 100. Air is directed to the air jet through conduit 156 and exist downwardly therefrom through a series of small openings, not shown.

Upon fusing of the interfacing liner tape 140 to the fabric section x the air regulator 152 is deactivated by the controller which permits roller 150 to move downward to the FIG. 4 position, thus permitting the hot plate 130 to drop downwardly slightly out of contact with the fabric section x prior to being retracted by the fluid cylinder 132 to prevent damage to the fabric and tape. At the same time the controller actuates the cylinder 132 to withdraw the hot plate to the FIG. 5 position.

Motor 88 drives the belts 50, upon receiving a signal from the controller to advance the blank fused to the liner tape towards the sewing instrumentalities of the machine 32. When the forward edge of the advancing blank is detected by the sensor 160, FIG. 1, the sewing instrumentalities are activated, through the controller to hem the blank by stitching thus forming line 162 on pocket 24.

After the pocket 24 leaves the sewing instrumentalities, advanced by drive belts 50, the chain of stitches trailing from the sewing instrumentalities and the liner tape 140 connecting any preceding or following pieces of fabric pockets is severed to define a discrete pocket. The chopper, or cutting mechanism 34, shown schematically in FIG. 8, is actuated twice by the controller, upon receiving a signal from an electric eye 166 which senses the position of the advancing pocket to sever the liner tape and any chain stitching between the pocket and a subsequent advancing pocket. A vacuum head, not shown, may be provided for receiving the severed pieces and directing them through conduit 168 to a waste collector 170.

The cutting mechanism 34 may be of the type, for example, disclosed in U.S. Pat. Nos. 4,008,637; 4,040,366; and 4,550,670.

Figure 12:
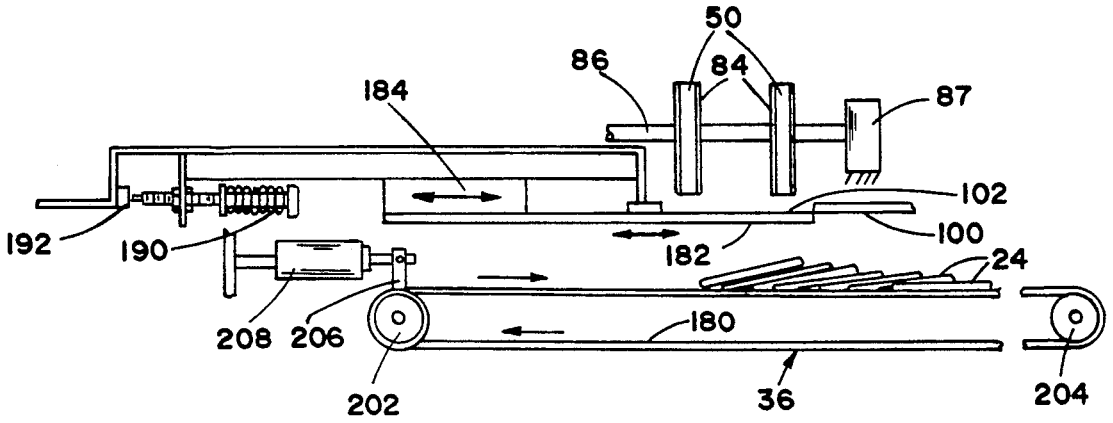
FIG. 12 is a fragmentary end elevational view of the assembly for discharging the hemmed components from one conveyor to another and for stacking the components.
Figure 13:
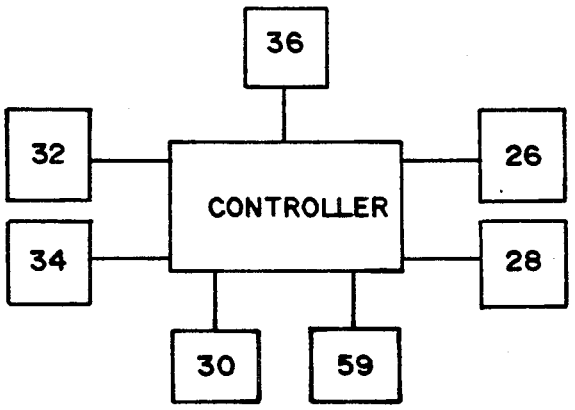
FIG. 13 is a simplified block diagram of various components.

After the blanks have been hemmed and the interconnecting liner tape severed to define discrete pockets, they are collected by the mechanism 36. As shown by FIGS. 1 and 12, a rectangular opening 102 is provided in the plate 100 for permitting the pockets 24 to drop therethrough onto a conveyor belt 180 as the pockets are advanced by the belts 50,50.

Figure 9:
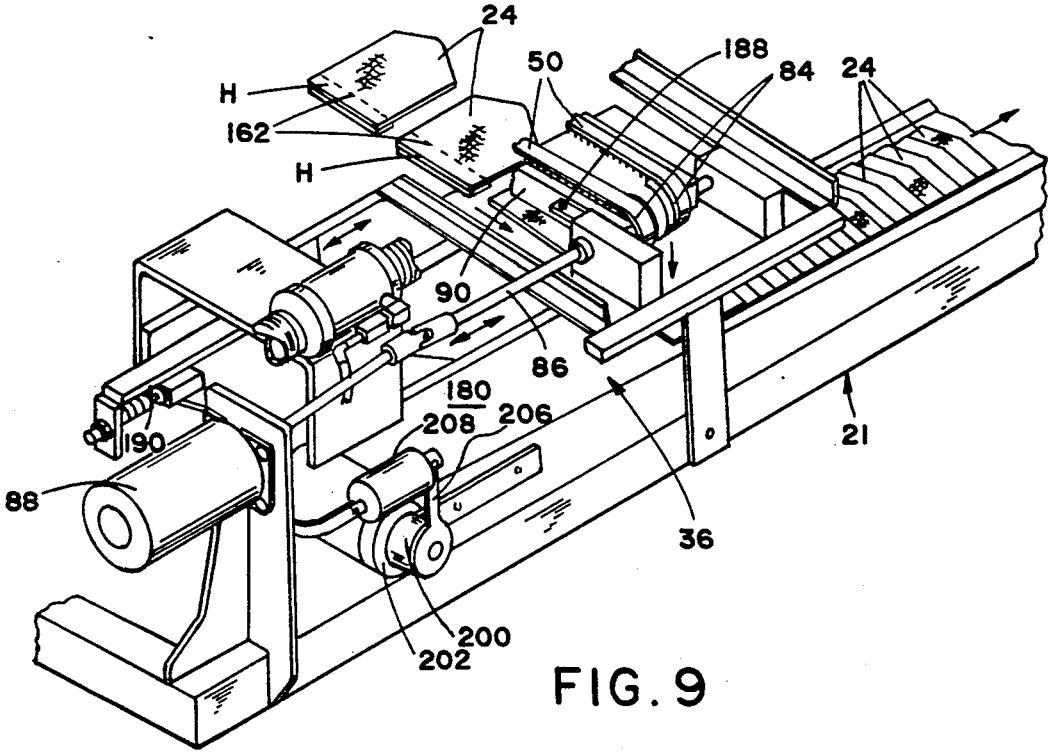
FIG. 9 is a fragmentary, perspective view of the apparatus illustrating the assembly for discharging the hemmed components from a first conveyor and stacking them on a second conveyor.

A drop plate 182, FIG. 12, is secured to a fluid cylinder 184 for selective reciprocable displacement to open or close the opening 102. The fluid cylinder 184 is actuated through the controller to withdraw the drop plate 182 when the leading edge of a pocket 24 being advanced by the belts 50,50 is detected by a photocell 188, FIG. 9. As the drop plate slides to permit a pocket to drop through opening 102 onto the conveyor belt 180, a portion of the fluid cylinder engages a bumper 190 which, in turn, actuates a switch 192 for reversing, through the controller, the cylinder 184 and again closing the opening 102 by the drop plate 182.

The conveyor belt 180, which extends around rollers 202,204, is incrementally advanced through a ratchet clutch 200 coupled to the roller 202. The clutch is actuated through a lever 206 and fluid cylinder 208.

Each of the various components may be controlled in a conventional and well-known manner by the controller. The specific controls for the various functions form no part of the invention apart from defining an operative system and presenting a complete disclosure.

What is claimed is:

1. Apparatus for the sewing of fabric blanks into garment components comprising, support means, a machine having sewing instrumentalities mounted upon said support means, means for sequentially advancing fabric blanks towards said sewing instrumentalities, means for directing a liner tape having a thermally actuatable adhesive thereon in a prescribed manner with the sequentially advanced fabric blanks, means for folding a selected portion of each fabric blank into overlapping position with said liner tape and applying heat to said liner tape to adhesively bond it to each fabric blank, said means for sequentially advancing said fabric blanks directing said blanks having folded portions bonded to said liner tape to said sewing instrumentalities for sewing said fabric blank folded portions to define hems, means for severing said liner tape intermediate adjacent hemmed fabric blanks to define discrete garment components, and means for receiving said garment components in a desired orientation.

2. Apparatus as recited in claim 1, wherein said means for folding a selected portion of each fabric blank into overlapping position with said liner tape and applying heat to said liner tape includes a hot plate mounted for reciprocable displacement.

3. Apparatus as recited in claim 2, wherein said means for folding a selected portion of each fabric blank into overlapping position with said liner tape and applying heat to said liner tape further includes pressure means for urging said hot plate into clamping engagement with said selected portion of a fabric blank and the liner tape to fuse the blank and tape together.

4. Apparatus for manufacturing hemmed garment components comprising; means for facilitating alignment of a fabric blank in a prescribed manner, means for advancing said fabric blank along a support surface with a prescribed portion depending from a marginal edge of said support surface; means for positioning a selected portion of a fusible interfacing beneath said support surface and selectively aligned with said marginal edge, means displaceble transversely of said marginal edge for urging said fabric blank predetermined portion into clamping engagement with said fusible interfacing and applying heat thereto to provide a bond therebetween, and means for sewing said fabric blank to define a hemmed garment component.

5. In combination with a sewing machine having instrumentalities for sewing selected folded portions of a series of sequentially advancing fabric blanks interconnected by a continuous heat fusible interfacing tape as the blanks are advanced through the sewing instrumentalities; support means, means for sequentially advancing fabric blanks along said support surface, reciprocable means for folding one side of said fabric blanks in overlapping engagement with said interfacing tape and fusing said tape to said blanks, and cutter means located downstream of said sewing instrumentalities for severing said tape intermediate adjacent advancing fabric blanks to define discrete garment components.

6. The apparatus of claim 5, said support means, downstream of said cutter means, defining an opening through which said garment components are selectively discharged, and means for receiving in an oriented manner the garment components discharged through said opening.

7. The apparatus of claim 5, and further including orientation of means for facilitating alignment of the fabric blanks prior to being advanced along said support means, said orientation means including means for sensing proper alignment of each blank and feeding the aligned blank to said means for sequentially advancing the fabric blanks.

8. A method of fabricating hemmed fabric components from fabric blanks comprising the steps of: advancing a selectively oriented fabric blank to a prescribed fixed position in aligned relationship with an elongated fusible interacting tape; folding a marginal edge portion of said fabric blank into overlapping, abutting relation with the fusible tape while said fabric blank is in the prescribed fixed position; applying heat to the fusible tape to secure it to the fabric blank in the prescribed fixed position; advancing the fabric blank and fusible tape from said fixed position along a prescribed path; and hemming the fabric blank to define a fabric component.

9. A method of continuously sequentially fabricating garment components from fabric blanks comprising the steps of: sequentially orienting fabric blanks in a prescribed manner; intermittently sequentially advancing the fabric blanks along a first path to a fixed position at a first station; intermittently directing a continuous length of a heat fusible liner tape along a second path, the first and second paths at said first station being superimposed; folding simultaneously an entire marginal edge portion of each fabric blank as it is fixedly positioned at the first station into overlapping engagement with a portion of the heat fusible liner fixedly located at the first station; applying pressure and heat to the folded entire marginal edge portion of each blank and the liner located at the first station to bond the blanks and liner together; feeding the blanks and liner to sewing instrumentalities; and hemming the folded blanks to define garment components.

10. The method as recited in claim 9, and further including the steps of severing the liner tape extending between adjacent garment components as the garment components are advanced along the first path.

11. The method as recited in claim 10, and further including the step of discharging the garment components sequentially from the first path to a receiver with the garment components in overlapped, stacked relation.

* * * * *